US005281169A

United States Patent [19]

Kiat et al.

[11] Patent Number: 5,281,169

[45] Date of Patent: Jan. 25, 1994

[54] SHIELDED ELECTRICAL CONNECTOR ASSEMBLIES

[75] Inventors: Toh S. Kiat, Singapore; Daniel A. Dixon, Holland Hill Mansions; Yap Y. Teck, Cashew Heights; Yuen P. Wong, Singapore, all of Singapore; David L. Brunker, Naperville, Ill.

[73] Assignee: Molex Incorporated, Lisle, Ill.

[21] Appl. No.: 6,562

[22] Filed: Jan. 21, 1993

[51] Int. Cl.[5] ..... H01R 13/00

[52] U.S. Cl. ..... 439/607

[58] Field of Search ..... 439/607-610

[56] References Cited

U.S. PATENT DOCUMENTS

| | | | |
|---|---|---|---|
| 4,842,554 | 6/1989 | Cosmos et al. | 439/609 |
| 4,913,664 | 4/1990 | Dixon et al. | 439/607 |
| 4,925,405 | 4/1990 | Wei | 439/608 |
| 4,981,447 | 1/1991 | Ichitsubo | 439/607 |
| 5,017,156 | 5/1991 | Sugiyama | 439/607 |
| 5,017,158 | 5/1991 | Liu et al. | 439/609 |
| 5,041,022 | 8/1991 | Sekiguchi | 439/609 |
| 5,083,945 | 1/1992 | Miskin et al. | 439/607 |
| 5,096,440 | 3/1992 | Katsumata | 439/570 |
| 5,137,472 | 8/1992 | Hillbish et al. | 439/607 |
| 5,192,228 | 3/1993 | Collins et al. | 439/607 |

*Primary Examiner*—Joseph H. McGlynn

*Attorney, Agent, or Firm*—Stacey E. Caldwell

[57] ABSTRACT

An electrical connector assembly is provided for mounting on a surface of a printed circuit board. The assembly includes a generally rectangular dielectric housing. A front of the housing defines a mating end for receiving a projecting portion of a mating connector. A generally rectangular conductive shield is disposed about portions of the housing and combines therewith to define a peripheral envelope of the connector assembly. The shield includes outside walls for covering at least some of the outside surfaces of the housing. At least one surface mounting foot is integral with at least one of the outside walls of the shield for securing the connector assembly to the surface of the printed circuit board. The surface mounting foot is located within the peripheral envelope of the connector assembly. The foot is formed at an opening in the shield which provides access through which visual observation can be made of the integrity of the surface mounting interface between the foot and the printed circuit board. The shield is disclosed as a two-piece shield, and improved dimpled overlapping interfaces are provided at open seams between the two pieces of the shield, and improved grounding feet are provided for commoning the two pieces of the shield.

11 Claims, 5 Drawing Sheets

SHIELDED ELECTRICAL CONNECTOR ASSEMBLIES

FIELD OF THE INVENTION

This invention generally relates to the art of electrical connectors and, particularly, to a shielded connector assembly providing protection against electromagnetic interference, radio frequency interference, and the like.

BACKGROUND OF THE INVENTION

Shielded electrical connector systems are used in many applications, including telecommunications equipment, computers, other digital information systems, and the like. The electrical circuitry in such applications include electrical cables having a plurality of electrically conductive leads surrounded and protected by an electrically conductive shield, such as a braid, foil or the like. In most such applications, it is necessary to shield the signal-carrying circuits to avoid electromagnetic interference caused by energy generated outside of as well as inside the system, thus "hardening" the system to the ingress and egress of radiated emissions.

Many such electrical connectors are used in conjunction with systems which incorporate printed circuit boards to which the connectors are surface-mounted. The board is provided with ground planes or ground circuits to which the connectors are conductively coupled. The coupling usually is through the shields of the connectors.

One type of miniature electrical connector of the character described is commonly called a circular DIN connector (or a "mini-DIN" connector) and is known to include a dielectric housing in which electrical terminals are mounted. The mini-DIN connector usually is rectangularly shaped in cross-section and a rectangular body or housing has a top, bottom, front, rear and opposite sides. The front of the housing defines a mating end for receiving a projecting portion of a mating connector or cable plug. This mating end includes a circular recess within which a circular cross-sectional plug portion projects forwardly for receiving a circular cross-sectional, externally shielded electrical socket of the mating connector. A rectangularly configured shield is disposed about portions of the housing and has means for making electrical contact with the shield of the mating connector. The shield usually is fabricated from stamped and formed sheet metal material. The metal shield may include a front wall over the front of the housing, the front wall including a series of spring fingers for making electrical contact with the shielding of the mating connector. In addition to the front wall, the shield may include one or more of a top wall over the top of the housing; a rear wall over the rear of the housing and opposite side walls over the opposite sides of the housing.

Another type of rectangular shielded electrical connector assembly of the character described is a telecommunications connector or jack which also is rectangular of "box"-shaped and includes a rectangularly-shaped dielectric housing having portions of the outside thereof covered by a stamped and formed metal shield having planar walls covering some of the outside walls of the housing, similar to the circular mini-DIN connector. An example of a shield for such a telecommunications connector is shown in U.S. Pat. No. 5,083,945, dated Jan. 28, 1992, and which is assigned to the assignee of the present invention.

One of the problems with shielded electrical connector assemblies as described above involves mounting the connector including the shield to the printed circuit board. The most common mounting system includes a plurality of mounting members such as tabs or tails formed integrally with the shield, usually the side walls of the shield, and projecting through and soldered within holes in the printed circuit board. This configuration provides strain relief for the fragile terminals particularly when they are surface mounted to contact pads of the circuitry on the printed circuit board. It may further provide an electrical connection such as a ground connection to the circuitry. However, with the increasing miniaturization and complexity of circuit design, such hole-mounted tails often cannot be used, particularly where circuit components are mounted on both sides of a printed circuit board. In such applications, mounting members cannot project through the board where they might interfere with circuit components on the opposite side of the board. Therefore, separate metal retaining plates have been proposed to secure a surface mounted connector to a contact pad of a printed circuit board, as shown in U.S. Pat. No. 5,096,440, dated May 17, 1992. Such separate metal retaining plates have first portions anchored to the connector housing and second portions reflow soldered to the pads on the printed circuit board. Unfortunately however, the use of such separate retaining plates may add considerably to the overall cost of manufacturing the connectors and assembling the connectors to the printed circuit board. Furthermore, the plates may use up valuable printed circuit board "real estate" when the plate is not located substantially with the peripheral envelope of the connector assembly.

Another continuing problem with shielded electrical connector assemblies of the character described above involves providing adequate grounding of the connector shield to the printed circuit board. As stated above, the shields are electrically coupled to shielded mating connectors and associated shielded cables, and the shields therefore must be connected to ground traces on the printed circuit board. This must be done in order to establish and maintain effective shielding of the attached shielded cables and their associated peripherals. This invention is directed to various schemes which improve the grounding network of such shielded connectors.

Still further, some shields are fabricated of a plurality of parts, such as a two-piece shield, for various reasons, including cost effectiveness. Unfortunately, it has been difficult to common the parts of the shield to provide adequate shielding and grounding throughout the entire connector assembly. This invention is directed to providing improvements in plural component shields to enhance the shielding and grounding characteristics thereof.

SUMMARY OF THE INVENTION

An object, therefore, of the invention is to provide a new and improved shielded electrical connector assembly of the character described.

In the exemplary embodiment of the invention, an electrical connector assembly is disclosed for mounting on a surface of a printed circuit board. The assembly includes a generally rectangular dielectric housing, with a front of the housing defining a mating end for receiving a projecting portion of a complementary mating connector. A generally rectangular conductive shield is disposed about portions of the housing and combines therewith to define a peripheral envelope of the connector assembly. The shield includes outside walls for covering a portion of the outside surfaces of the housing.

The invention contemplates that at least one of the outside walls of the shield include a surface mounting foot integral therewith for securing the connector assembly to the surface of the printed circuit board. The surface mounting foot is located substantially entirely within the peripheral envelope of the connector assembly. As disclosed herein, the shield is fabricated of sheet metal material, and the surface mounting foot is bent inwardly from a lower portion of an outside wall. The foot is formed at an opening in the wall, whereby the opening provides access means through which visual observation can be made of the integrity of the surface mounting interface between the foot and the printed circuit board.

Another feature of the invention is directed to improved grounding between the complementary mating connector and the printed circuit board. Specifically, a front wall of the shield includes an opening for receiving the mating connector. A grounding foot is provided integral with the front wall for surface engaging a ground circuit on the printed circuit board. The grounding foot is located substantially immediately below the opening to provide a direct and immediate path between the complementary connector and the circuit board.

Another feature of the invention is the provision of improved interface means at overlapped areas of the shield, such as at an open seam of the shield. Specifically, the shield is disclosed herein as a two-piece shield assembly, the two pieces being joined at open seams. Overlapping portions of the shield pieces adjacent the seams are provided with a plurality of dimples which define interference points of high contact pressures which, in turn, ensure a good electrical path between the two shield pieces. The dimpled interfaces facilitate maintaining the shield pieces at equal voltage potential, thereby minimizing the chances of re-radiation and radio frequency leakage.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
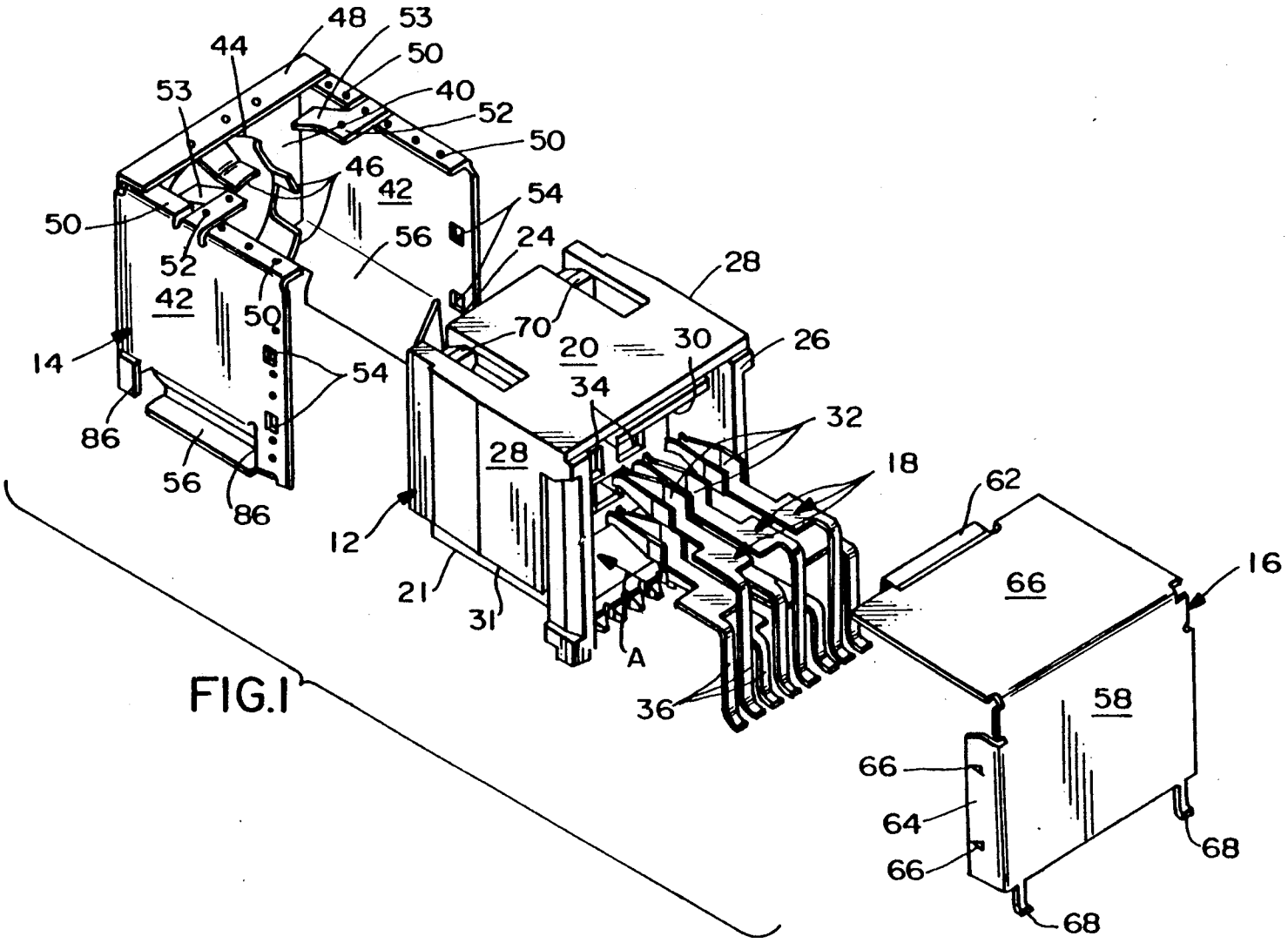
FIG. 1 is an exploded rear perspective view of an electrical connector assembly embodying the concepts of the invention.

Referring to the drawings in greater detail, and first to FIG. 1, the features of the invention are incorporated in an electrical connector assembly, generally designated 10, which includes a generally rectangular dielectric housing, generally designated 12, for mounting on a surface of a printed circuit board; a two-piece shield which includes a front shield piece, generally designated 14, and a rear shield piece, generally designated 16; and a plurality of terminals, generally designated 18, mounted within housing 12.

More particularly, housing 12 is rectangular in cross section to define a top 20, a bottom 22, a front 24, a rear 26 and opposite sides 28. Bottom 22 of the housing is juxtaposed to a top surface of a printed circuit board when the connector assembly is surface mounted to the board. Front 24 of the housing defines a mating end of the connector assembly for receiving a projecting portion of a complementary mating connector, as described hereinafter. Rear 26 of the housing defines an open cavity 30 into which terminals 18 are inserted in the direction of arrow "A". Lastly, it should be noted that a stepped or recessed area 31 is formed along the bottom of each side 28 of the housing. The entire housing may be unitarily molded of dielectric material such as plastic or the like.

Each terminal 18 includes a female contact end 32 insertable into a respective passage 34 in housing 20, whereby the female contact ends of the terminals can be interconnected with pin contacts or terminals of the complementary mating connector. Each terminal 18 also includes a right-angled tail portion 36 projecting downwardly to distal ends which are defined by terminal feet 38 for surface mounting to appropriate circuit traces on the printed circuit board.

Front shield piece 14 includes a front wall 40 for covering front 24 of housing 20, and a pair of side walls 42 integral with and projecting rearwardly from the side edges of front wall 40 for substantially covering the opposite sides 28 of the housing. Front wall 40 includes a circular opening 44 for receiving the projecting portion of the complementary mating connector, as described hereinafter. A plurality of spring fingers 46 are integral with and project inwardly from the periphery of opening 44 in front wall 40 for engaging an external shield of the mating connector. A top front flange 48 is formed integral with and projects rearwardly from the top edge of front wall 40. A pair of top side flanges 50, separated by a latch tab 52, all are integral with and project transversely inwardly from the top edge of each side wall 42. Each latch tab includes an inwardly bent latch portion 53. Each side wall 42 has a pair of latch apertures 54 for purposes described hereinafter. In addition, each side wall 42 includes a surface mounting foot 56, described below integral with and located substantially entirely inwardly of the respective side wall for securing the connector assembly to the surface of the printed circuit board and an inwardly projecting hook portion 57 for securing each side wall 42 to its respective side 28. The entire front shield piece 14 is fabricated of stamped and formed sheet metal material. Finally, dimples or bosses, described in detail below, are located along surfaces of the front shield piece which interface, mechanically and electrically, with complementary surfaces of the rear shield piece.

Rear shield piece 16 includes a rear wall 58 for covering the rear 26 of housing 12, including open cavity 30 and the terminals therewithin, along with a top wall 60 integral with and projecting forwardly from the top edge of rear wall 58. The top wall has an elongated tongue 62 which is bent out of the plane of the top wall, inwardly therefrom, so that the tongue seats under top front flange 48 of front wall 40 of front shield piece 14 when the shield pieces are assembled. In other words, tongue 62 of rear shield piece 16 and top front flange 48 of front shield piece 14 will be overlapped in assembly. It also should be noted that, in the assembled condition of the shield, top wall 60 of rear shield piece 16 will overlap top flanges 50 and latch tabs 52 of the side walls of front shield piece 14. Rear wall 58 includes a pair of opposite side flanges 64 integral with and projecting forwardly from the side edges of the rear wall. These side flanges will overlap the outside of side walls 42 of front shield piece 14 in the assembled condition of the shield. A pair of stamped latch detents 66 are formed out of each side flange 64 for snap-engagement within latch apertures 54 in side walls 42 of front shield piece 14 to latch the two shield pieces together about housing 12 in assembled condition. Lastly, a pair of grounding feet 68 are formed integral with and project downwardly from the lower edge of rear wall 58 for connection, as by soldering, to ground traces or pads on the printed circuit board. Rear shield piece 16 is fabricated of stamped and formed sheet metal material.

Figure 2:
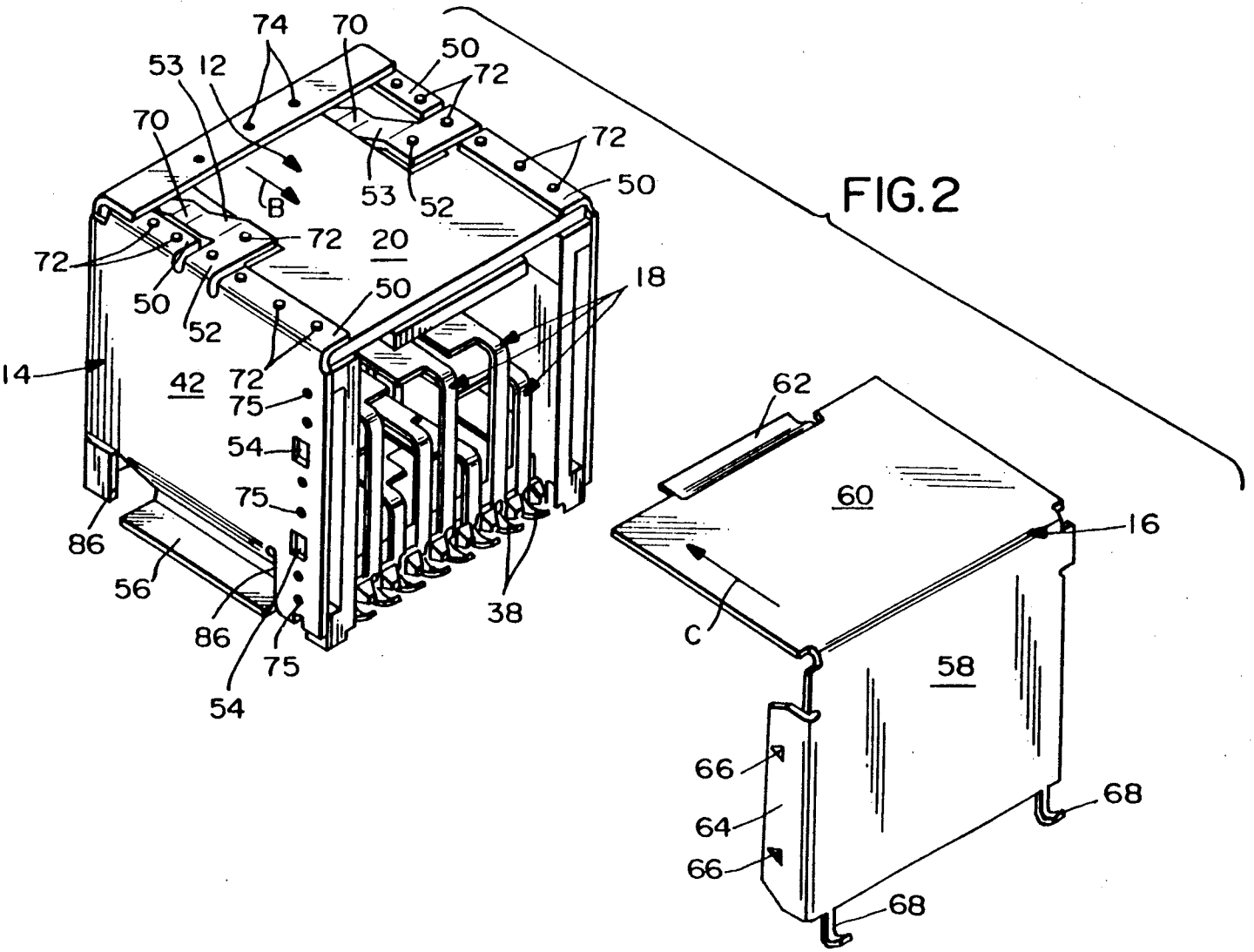
FIG. 2 is a rear perspective view of the housing, front shield piece and terminals in assembled condition, with the rear shield piece about to be assembled thereto.

FIG. 2 shows terminals 18 inserted into housing 12, and front shield 14 assembled about the housing. Terminal feet 38 and surface mounting feet 56 of front shield piece 14 are in a coplanar disposition at the bottom of the housing for surface mounting the connector assembly to a top surface of the printed circuit board. It can be seen that side walls 42 of the front shield piece substantially entirely cover the sides of the housing. Top front flange 48 of the front wall of the shield piece, along with top side flanges 50 and latch tabs 52 of the side walls of the shield piece, all overlie the top 20 of housing 12. In this view, it can be seen that the top of the housing is provided with a pair of ramped latch bosses 70 behind which latch portions 53 of latch tabs 52 snap into engagement when front shield piece 14 is assembled to the housing in the direction of arrow "B". This interengagement locks the front shield piece to the housing, in position for subsequent assembly of rear shield 16 to the housing, in the direction of arrow "C".

FIG. 2 also shows a feature of the invention wherein top side flanges 50 and latch tabs 52 are stamped with a plurality of upwardly projecting dimples or bosses 72. Similarly, top front flange 48 of the front wall of the shield is stamped with a plurality of dimples or bosses 74, but dimples 74 project downwardly or inwardly from flange 48. Inwardly projecting dimples 75 also are provided along the rear edge of side walls 42 for engaging side flanges 64 of the rear wall 58 of rear shield piece 16. Therefore, when rear shield piece 16 is assembled by force-fitting tongue 62 under flange 48 of the front shield piece, the inwardly directed dimples 74 establish a positive interengagement between the flange 48 and the tongue 62. Similarly, when the stamped latch detents 66 of side flanges 64 are snapped into latch apertures 54 in the side walls of the front shield piece, top wall 60 of the rear shield piece will be biased into engagement with the upwardly projecting dimples 72 of top side flanges 50 and latch tab 52 and inwardly projecting dimples 75 will engage side flanges 64 of rear shield piece 16 to similarly establish a positive engagement between those components. These dimples can be considered as interference points of high contact pressures which, in turn, ensure a good electrical path between the two shield pieces. Placing the interference dimples between the overlapped portions of the two shield pieces, at otherwise open seams of the shield, ensures that the interfacing shield pieces are at equal voltage potential, thereby minimizing the chances for re-radiation and radio frequency leakage.

Figure 3:
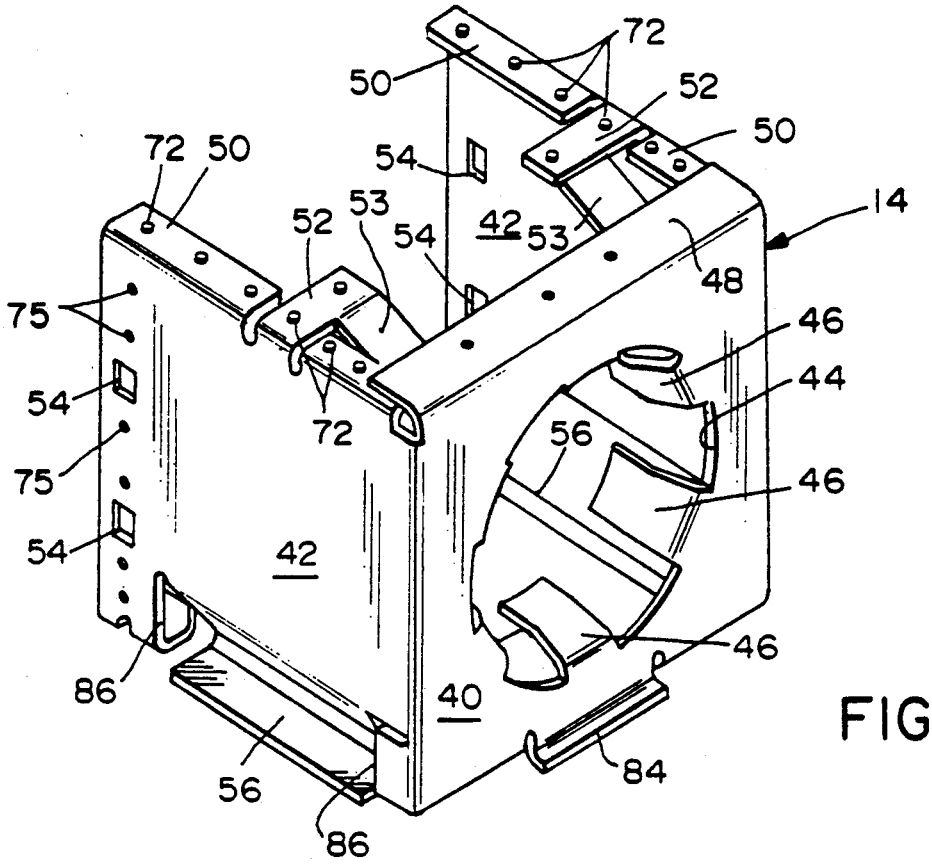
FIG. 3 is a front perspective view of the front shield piece.
Figure 4:
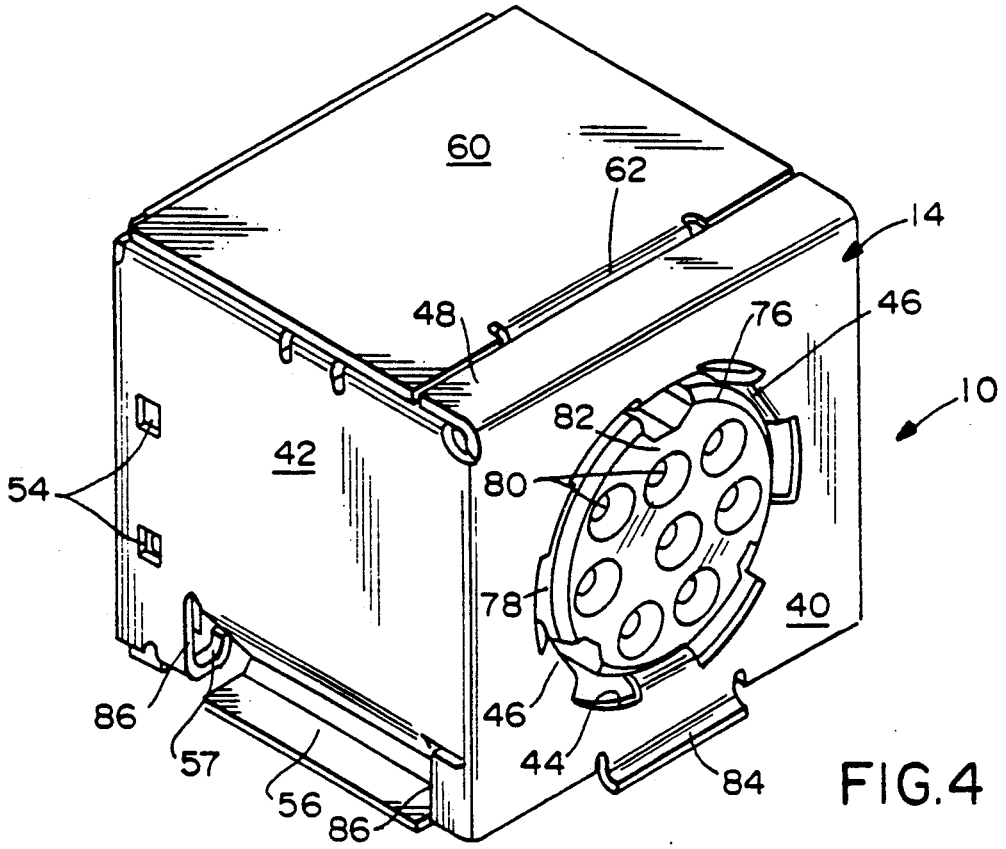
FIG. 4 is a front perspective view of the fully assembled electrical connector assembly.
Figure 5:
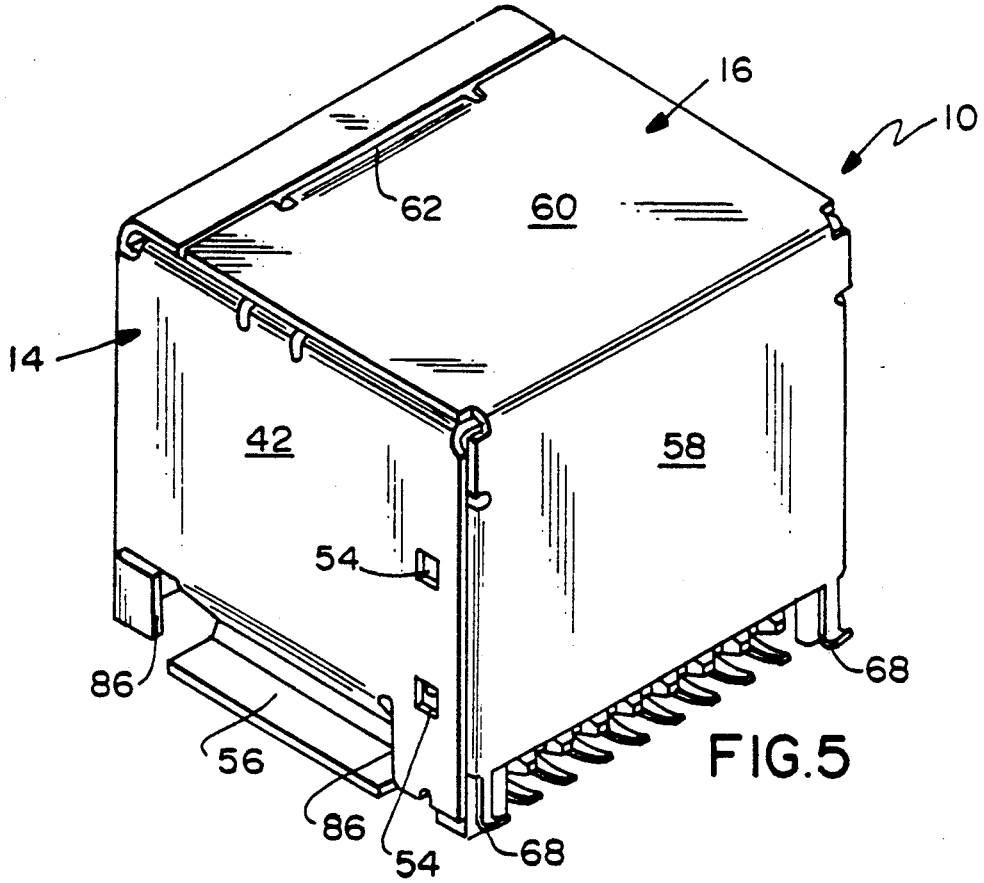
FIG. 5 is a rear perspective view of the fully assembled electrical connector assembly.

FIGS. 3 and 4 show front shield piece 14 (FIG. 3) and the entire assembled electrical connector assembly 10 (FIG. 4) in a front perspective depiction. In FIG. 3, it can be seen how fingers 46 project into the inside of the shield piece from the edge of opening 44 in the front wall 40 of the shield piece. It also can be seen how surface mounting foot 56, at the bottom edge of side wall 42 of the front shield piece, is formed in a general V-shaped configuration, rotated approximately 90°, wherein the foot first extends inward and then extends back toward the sidewall 42 to provide a surface for soldering to the printed circuit board. The shape and location of surface mounting foot 56 allows it to be located within the recessed area 31 along the bottom side edges of housing 12 and to thus be contained substantially entirely within the peripheral bounds of the shield piece. Note that although only one surface mounting foot is shown in FIGS. 3 and 4, a second surface mounting foot is formed on the opposite sidewall 42, as shown in FIGS. 1, 2 and 5. It also should be noted in all of FIGS. 1–5 that surface mounting feet 56 are stamped and formed out of openings 86 in side walls 42 of the front shield piece. These openings provide access means to afford visual observation of the integrity of the surface mounting interfaces of the feet to the contact pads on the printed circuit board.

FIG. 4 shows that housing 12 (FIG. 1) includes a forwardly projecting plug portion 76 surrounded by a circular recess 78 within which fingers 46 of the front wall of the front shield piece project. A plurality of terminal-receiving passages 80 communicate with a front face 82 of plug portion 76. This is of a known configuration, whereby a cylindrical metal external shield of the complementary mating connector is inserted into circular recess 78 and into engagement with fingers 46 to ground the external shield of the mating connector to the shielding means of connector assembly 10. The male terminal pins of the mating connector are inserted into passages 80 for interconnection with the female contact ends 32 (FIG. 1) of terminals 18.

FIGS. 3 and 4 also show a feature of the invention for improving the overall shielding performance of electrical connector assembly 10. More particularly, it can be seen that front wall 40 of front shield piece 14 includes a surface mounting ground foot 84 in the form of a laterally extending flange integral with front wall 40 at the bottom edge thereof. It also should be noted that ground foot 84 is located immediately below opening 44 in the front wall and the area within the opening wherein the shielding means of the connector assembly is grounded to the external shield of the complementary mating connector. By positioning ground foot 84 directly below this interfacing area, a direct and immediate path is made to a ground trace on the printed circuit board for terminating the shield of an associated shielded cable. Similar to surface mounting feet 56, ground foot 84 may be formed in a rotated V-shaped configuration, fitting within a housing recess and therefore located substantially, entirely within the peripheral bounds of the shield piece.

FIG. 5 shows a rear perspective view of the completely assembled electrical connector assembly 10, i.e. 180° opposite the depiction of FIG. 4. Again, in the depiction of FIG. 5, it can be seen that the surface mounting foot 56 on the side of the connector, opposite the mounting foot 56 shown in FIG. 4, is bent inwardly within the peripheral bounds of the external shielding means of the connector assembly. Therefore, it can be understood that the entire connector assembly may be contained within a peripheral envelope defined by the outside dimensions of the assembly. By locating surface mounting feet 56 within this peripheral envelope, valuable printed circuit board area or "real estate" is not used up. This is important in integrated circuitry where increasing miniaturization and complexity of the circuitry design often requires close spacing between adjacent connectors or other circuit components. Surface mounting feet 56 simply are soldered to contact pads on the surface of the printed circuit board.

Lastly, FIG. 5 again shows the location of ground feet 68 projecting downwardly from rear wall 58 of the rear shield piece. To this end, reference now is made to the schematic illustration of FIG. 6 which represents the location of a plurality of conductive contact pads on a printed circuit board. Of course, although not shown, it should be understood that the conductive contact pads shown in FIG. 6 are interconnected to appropriate circuit and ground traces on the printed circuit board, in known fashion.

Figure 6:
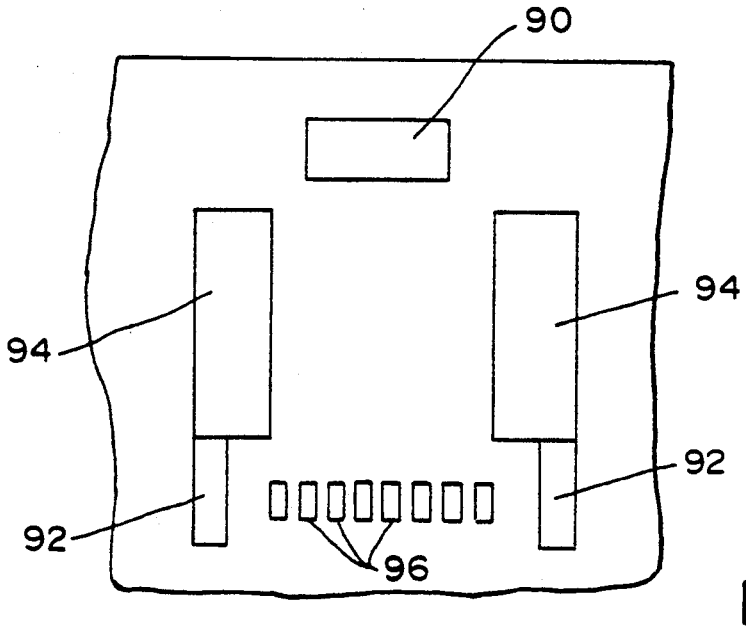
FIG. 6 is a somewhat schematic illustration of the contact pads on a printed circuit board.

More particularly, FIG. 6 shows a front contact pad 90 to which ground foot 84 (FIG. 4) of front shield piece 14 is interconnected, as by soldering. A pair of rear contact pads 92 are located for interconnection with ground feet 68 (FIG. 5) of the rear shield piece 16. Appropriate ground circuit traces (not shown) on the printed circuit board interconnect contact pads 90 and 92 to common the two shield pieces to the printed circuit board. FIG. 6 also shows a pair of side contact pads 94 for soldering to surface mounting feet 56, as well as a plurality of signal contact pads 96 for soldering to feet 38 of terminals 18.

Figure 7:
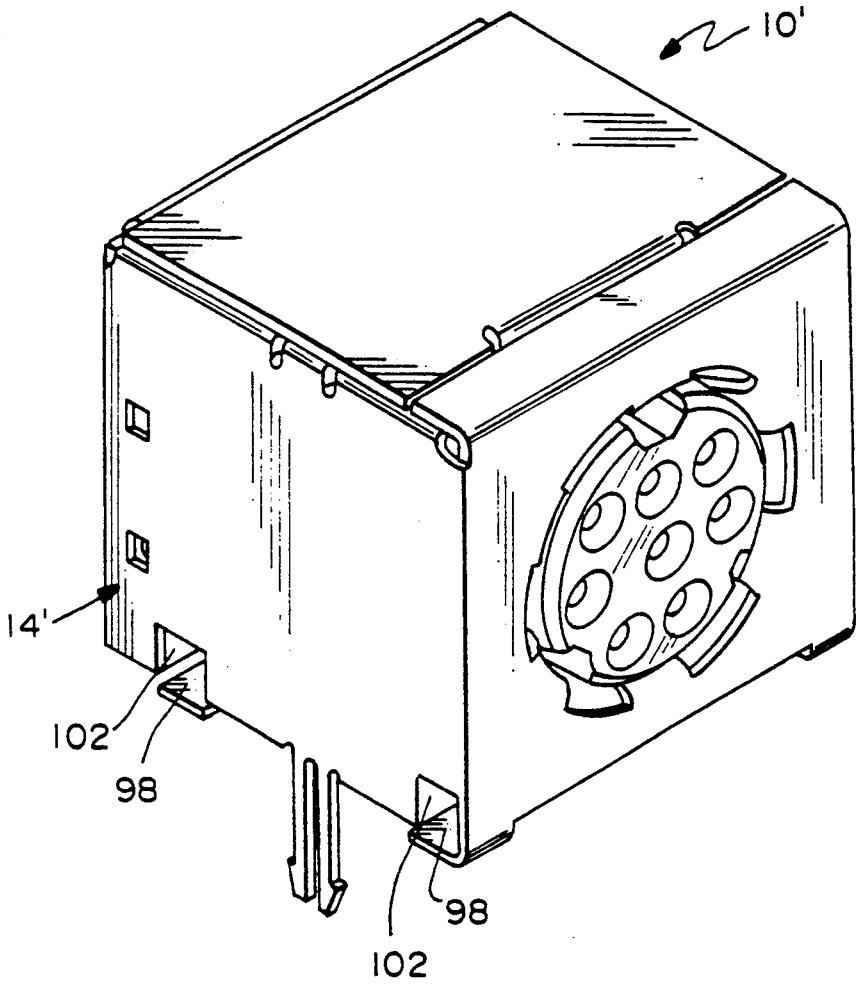
FIG. 7 is an exploded perspective view of an alternate embodiment of the electrical connector assembly.

Finally, FIG. 7 shows a modified embodiment of the invention wherein like numerals have been applied to like components described above in relation to the embodiment of electrical connector assembly 10. The embodiment of the electrical connector assembly in FIG. 7 has been generally referenced 10'.

Specifically, electrical connector assembly 10' in FIG. 7 includes a front shield piece, generally designated 14' and a rear shield piece, generally designated 16', the shield pieces substantially surrounding a housing, generally designated 12'. Front shield piece 14' includes four surface mounting feet 98 (two shown). As with the embodiment of the invention shown in FIGS. 1–6, shield pieces 14' and 16' are fabricated of sheet metal material, and, thereby, surface mounting feet 98 are in the form of flanges or tabs bent inwardly so as to be confined within the overall peripheral envelope of electrical connector assembly 10'. As stated above, this saves valuable real estate on the printed circuit board. Like surface mounting feet 56 of electrical connector assembly 10, surface mounting feet 98 of electrical connector assembly 10' are interconnected to contact pads on the printed circuit board, as by soldering.

Still further, in the embodiment of FIG. 7, surface mounting feet 98 of front shield piece 14' are located at openings 102. These openings 102 provide access means to afford visual inspection of the integrity of the mounting interfaces between feet 98 and their respective contact pads on the printed circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly for mounting on a surface of a printed circuit board, including a generally rectangular dielectric housing, a front of the housing defining a mating end for receiving a projecting portion of a complementary mating connector, a plurality of surface mount terminals positioned in the housing and adapted to be electrically coupled to a plurality of first surface mounting pads on the surface of the printed circuit board for providing an electrical and mechanical connection between the connector assembly and the printed circuit board, and a generally rectangular conductive shield about portions of the housing and combining therewith to define a peripheral envelope of the connector assembly, the shield including outside walls for covering at least some of the outside surfaces of the housing, wherein the improvement comprises a surface mounting foot integral with one of the outside walls of the shield, the foot being located within the peripheral envelope of the connector assembly and adapted to be coupled to a second surface mounting pad on the surface of the printed circuit board, whereby the attachment of the surface mounting foot to the second surface mounting pad is adapted to provide strain relief to the surface mount terminals and to strengthen the mechanical connection between the connector assembly and the printed circuit board.

2. In an electrical connector assembly as set forth in claim 1, wherein said shield is fabricated of sheet metal material and the surface mounting foot is formed inwardly from a lower portion of one of the outside walls.

3. In an electrical connector assembly as set forth in claim 2, wherein said foot is formed at an opening in said wall, whereby the opening provides access means through which visual observation can be made of the integrity of the surface mounting interface between the foot and the printed circuit board.

4. In an electrical connector assembly as set forth in claim 2, wherein the surface mounting foot is formed having a generally v-shaped cross-section.

5. In an electrical connector assembly as set forth in claim 1, wherein the shield is a two-piece construction and comprises:

a first shield piece having a front wall with an opening for receiving the projecting portion of the mating connector, a pair of side walls integral with and projecting rearwardly from side edges of the front wall for covering opposite sides of the housing, and a top flange integral with and projecting rearwardly from a top edge of the front wall over a portion of the top of the housing; and a second shield piece having a rear wall for covering the rear of the housing, and a top wall integral with and projecting forwardly from a top edge of the rear wall over a portion of the top of the housing, the top flange of the front wall and the top wall of the rear wall substantially covering the top of the housing.

6. An electrical connector assembly as set forth in claim 5, wherein said first shield piece includes a first grounding foot on the front wall thereof for surface engaging a third surface mounting pad on the surface of the printed circuit board, the first grounding foot being located substantially directly below said opening of said first shield piece.

7. An electrical connector assembly as set forth in claim 6, wherein said second shield piece includes a second grounding foot at the bottom of the rear wall thereof for engaging a fourth surface mounting pad on the surface of the printed circuit board, wherein the fourth surface mounting pad is electrically connected to the third surface mounting pad, whereby a ground circuit is provided which commons the first and second shield pieces of the two-piece metal shield.

8. In an electrical connector assembly for mounting on a surface of a printed circuit board with board circuitry thereon, including a generally rectangular dielectric housing, a front of the housing defining a mating end for receiving an externally shielded projecting portion of a mating connector, a plurality of surface mount terminals positioned in the housing and adapted to be electrically coupled to a plurality of first surface mounting pads on the surface of the printed circuit board, and a generally rectangular conductive shield having a front wall with an opening for receiving the externally shielded projecting portion of the mating connector and an integral grounding portion for engaging the external shield of the projecting portion, wherein the improvement comprises a grounding foot integral with the front wall of the shield for surface engaging a second surface mounting pad on the surface of the printed circuit board, the grounding foot being located substantially directly below the opening of the front wall of the shield, whereby a direct and immediate electrical grounding path is effected between the mating connector and the board circuitry of the printed circuit board.

9. In an electrical connector assembly as set forth in claim 8, wherein said shield includes a rear wall with an integral grounding foot for engaging a third surface mounting pad on the surface of the printed circuit board, and the second surface mounting pad is electrically connected to the third surface mounting pad whereby a ground circuit is provided within the board circuitry which commons the front and rear walls of the shield.

10. An electrical connector assembly for mounting on a surface of a printed circuit board with board circuitry thereon, said electrical connector assembly comprising: a generally rectangular dielectric housing, a front of the housing defining a mating end for receiving an externally shielded projecting portion of a mating connector; a plurality of surface mount terminals positioned in the housing and adapted to be electrically coupled to a plurality of first surface mounting pads on the surface of the printed circuit board for providing an electrical and mechanical connection between the connector assembly and the printed circuit board; and a generally rectangular conductive shield having a rear wall substantially covering a rear surface of the housing, the shield having ground means for surface engaging a first surface mounting pad on the surface of the printed circuit board remote from the rear wall of the shield, and at least one grounding foot on the rear wall of the shield for surface engaging a second surface mounting pad on the surface of the printed circuit board, whereby the grounding foot can be commoned through the board circuitry to said ground means of the shield.

11. An electrical connector assembly comprising: a generally rectangular dielectric housing, a front of the housing defining a mating end for receiving a projecting portion of a mating connector, and a generally rectangular conductive shield about portions of the housing, the shield being fabricated of sheet metal material and including outside walls for covering some of the outside surfaces of the housing, and with adjacent portions of the outside walls of the shield being overlapped at a seam, wherein one of said overlapped portions includes a plurality of dimples projecting therefrom into engagement with the other overlapped portion to enhance commoning the outside walls at the seam.

* * * * *